United States Patent [19]

Kile et al.

[11] Patent Number: 4,862,039

[45] Date of Patent: Aug. 29, 1989

[54] LINE REGULATED BALLAST CIRCUIT

[75] Inventors: Edwin N. Kile, Dallas; Gary W. Irwin, Garland; Samuel S. Hartness, Mesquite, all of Tex.

[73] Assignee: Kile Technology Corporation, Garland, Tex.

[21] Appl. No.: 936,768

[22] Filed: Dec. 2, 1986

[51] Int. Cl.[4] ..... H05B 37/00

[52] U.S. Cl. ..... 315/194; 315/199; 315/279; 315/206; 315/224; 315/DIG. 7; 315/287

[58] Field of Search ..... 315/194, 199, 205, 206, 315/220, 222, 224, 226, 276–279, 287, 293, DIG. 4, DIG. 7

[56] References Cited

U.S. PATENT DOCUMENTS

| | | | |
|---|---|---|---|
| 1,939,903 | 12/1933 | Kayser | 315/279 X |
| 2,295,869 | 9/1942 | Seaman | 315/282 X |
| 2,354,696 | 8/1944 | Mettler | 315/279 X |
| 2,961,564 | 11/1960 | Kenty | 315/174 |
| 4,538,093 | 8/1985 | Melai | 315/283 X |
| 4,682,082 | 7/1987 | MacAskill et al. | 315/206 X |
| 4,700,111 | 10/1987 | Folwell et al. | 315/206 X |
| 4,712,170 | 12/1987 | Grace | 315/DIG. 7 X |
| 4,745,342 | 5/1988 | Andresen et al. | 315/281 X |

*Primary Examiner*—James J. Groody
*Assistant Examiner*—Mark R. Powell
*Attorney, Agent, or Firm*—H. Jay Spiegel

[57] ABSTRACT

The present invention relates to an improved line regulated ballast circuit for use in controlling varied lighting applications such as, for example, neon signs and fluorescent tubes. The inventive circuit, when used in neon lighting applications, may include a function generator which controls the lighting of the neon tube in a manner allowing the tube to slowly write from one end to the other in alternating current. The function generator also allows such functions as flashing, modulation, steady state operation and steady state operation with dimming function. In a further aspect, the inventive circuit with transformers connected in parallel with one another, may be utilized to simultaneously control a plurality of neon tubes, fluorescent tubes, or both concurerntly. In this application, each of the transformers may be provided with a shunting mechanism designed to render the output current thereof infinitely adjustable. The inventive circuit utilizes solid state components and is significantly lighter and smaller than known ballast circuits.

10 Claims, 3 Drawing Sheets

LINE REGULATED BALLAST CIRCUIT

BACKGROUND OF THE INVENTION

In the prior art, ballast circuits are well known. Most of them are extremely heavy and cumbersome and generate large amounts of heat during operation. Ballasts are used in many lighting applications and their main area of application consists of neon sign applications and fluorescent lighting applications.

Regarding the neon sign applications, neon signs customarily require on the order of up to 15,000 volts to drive the controlling circuit. Thus, neon signs as they are presently made, must be made with quite heavy support structure for high voltage conductors which makes neon signs as they are presently manufactured, extremely cumbersome and difficult to install. Further, the need for high voltages in neon signs drastically increases power usage as well as heat generation and makes such signs, over long periods of time, fire hazards.

Furthermore, the high voltages described above are necessarily a part of the present day magnetic transformers. Thus, a need has developed for an electrical circuit which may be utilized to control the lighting of neon signs which uses low voltage so that the signs do not have to be made with the cumbersome and heavy structure for high voltage conductors. Further, a need has developed for an electrical circuit to control a neon sign in a manner so that the entire sign may be lit uniformly.

In a further aspect, it is well known that in cooler weather, the intensity of known neon signs diminshes and accordingly, a need has developed for an electrical circuit to control a neon sign which may compensate for weather conditions in a manner such that the intensity of the light emanating from a neon sign may be kept uniform regardless of ambient temperature conditions.

Concerning fluorescent lighting applications, it is well known that most ballast circuits which are utilized in fluorescent lighting applications are extremely heavy and large and fill up a great portion of the lighting fixture housing. Since these heavy and cumbersome ballast systems generate a great deal of heat during their operation, in environments such as office buildings where a large number of fluorescent fixtures are used, the heat generated by the ballast circuits is significant enough to have an adverse effect on utility bills as additional air conditioning capacity is required to compensate for the heat generated by the ballast circuits. Furthermore, the extreme weight of these ballast circuits, when combined with the weight of the lighting fixtures themselves, contributes to making the handling of such lighting fixtures, during their installation, extremely difficult.

Thus, a need has developed for a new ballast circuit which will drastically reduce the weight of a lighting fixture including such ballast circuit with the lighter ballast circuit also generating less heat so that buildings having many such lighting fixtures may have cooling systems of less capacity with the resulting lowered utility bills.

In a further aspect, in all lighting applications, a need has developed for ballast circuitry with great versatility allowing the user thereof to control many different lighting applications with a single circuit, while allowing the user to control each particular lighting application in several ways, for example, dimming, flashing, etc.

In a further aspect, it is known that in neon circuits, often bubbles appear within the neon tube which bubbles are not desired. Applicant knows of no circuit which has yet been designed which enables one to control the formation and disappearance of these bubbles and a need has developed for circuitry which will enable one to controllably create and dissipate bubbles within a neon tube.

The following prior art is known to Applicants:

U.S. Patent 3,969,652 to Herzog discloses an electronic ballast circuit for gaseous discharge lamps which includes a time-ratio circuit and inductor which controls the current to the lamp. A closed loop feedback system ties the system together. This circuit is different from the teachings of the present invention since the present invention does not utilize a series switching regulator or TRC to control current to the lamp.

U.S. Patent 4,005,335 to Perper discloses a high frequency power source for fluorescent lamps and the like which comprises a protection circuit for use in "generally conventional invertors with oscillator circuits". The present invention is distinct from the teachings of this patent, mainly because the present invention does not use any protection circuit such as that which is set forth in this patent.

U.S. Patent 4,060,752 to Walker discloses a discharge lamp auxiliary circuit with dI/dt switching control. This patent discloses a high Q resonant circuit which is provided to maintain high output voltage when the lamp is started or re-ignited. Since the present invention does not use any resonant circuit which may be considered to be analogous to the teachings of Walker, this patent is believed to be irrelevant to the teachings of the present invention.

U.S. Patent 4,127,797 to Perper discloses an inverter oscillator with current feedback circuit. This patent discloses, over and above the Perper patent described hereinabove, the addition of a feedback circuit for regulation of the lamp load. Thus, since the present invention does not regulate in the manner contemplated in this patent, this patent is believed to be irrelevant to the teachings of the present invention.

U.S. Patent 4,277,726 to Burke discloses a solid state ballast circuit for rapid start type fluorescent lamps which operates from AC line voltage. This patent discloses a self-oscillating circuit and fails to disclose any control of the set point of inductors and capacitors in the circuit. The present invention utilizes control means which is clearly distinct from the teachings of this patent, as will be described in greater detail hereinbelow.

SUMMARY OF THE INVENTION

The present invention overcomes all of the deficiencies in the prior art as set forth above and provides a circuit with great versatility which is lightweight, compact and usable either alternatively or simultaneously in such varied lighting applications as neon signs and fluorescent fixtures.

The present invention includes the following aspects and features:

(a) The heart of the present invention consists of a ballast circuit including at its heart, a fixed frequency pulse-width-modulation control circuit chip. Interconnected with this chip are subcircuits including a frequency control regulator, a power oscillator, a 12-volt DC supply and a 300-volt DC supply.

(b) The inventive circuitry uses a modular approach with the output section of the power oscillator being connectable with a plurality of transformers connected in parallel with one another with each transformer so-connected being connectable through its secondary windings with a particular application circuit such as, for example, a neon sign or a fluorescent fixture. The present invention is so designed that a plurality of such transformers may be simultaneously connected in parallel and may simultaneously drive, in parallel, both neon circuits and fluorescent fixtures.

(c) If desired, a function generator may be connected to the frequency control regulator section of the line regulated ballast circuit. This function generator circuit, as presently contemplated, may control six functions. These functions are the following:

1. "Ramp up", wherein the frequency of the electrical current in the circuit is controllably increased;
2. "Ramp down", wherein the frequency of the current in the circuit is controllaby reduced;
3. "Flash", wherein the output current of the circuit is controllably turned on and off;
4. "Modulation", wherein during "Ramp up", "Ramp down" "Flash", the intensity of the light is adjusted;
5. "Steady state", wherein the current in the circuit is controlled for constant light intensity;
6. "Dimming", wherein during steady state operation, the intensity of the light may be adjusted.

(d) It should be understood that the "Ramp up" and "Ramp down" functions of the function generator may be utilized to enable a neon tube to "write". This is accomplished by performing "Ramp up" function to increase the frequency of the current outputted to the neon tube above a predetermined threshhold frequency, substantially instantaneously, whereupon the function of "Ramp down" is initiated to gradually reduce the frequency of the current in the circuit such that the neon within the neon tube begins to light at its first end and the lit portion of the tube increases in length until the entire tube is lit. In this way, the neon tube may "write" through the use of alternating current, a technique which has never before been accomplished to Applicants' knowledge.

(e) In a further aspect of the present invention, the line regulated ballast circuit includes structure which is specifically designed to enable the controlling of the presence or absence of "bubbles" within a neon tube. As discussed hereinabove in the background of the invention, bubbles are formed by discontinuities in the neon gas and previously, no one has been able to define structure which could either eliminate bubbles or present them as desired. In the inventive circuit, two output transistors are provided with the circuit being specifically devised so that one of these transistors stays on longer than the other one. This out-of-phase effect breaks up the harmonics in the tube which would cause the bubbles to appear. If, on the other hand, bubbles are desired, the circuit may be adjusted so that the output transistors operate in phase so that the bubbles will then appear. In further explanation of this phenomenon, prior art systems have resulted in the appearance of bubbles since these systems were required to operate at 60 cycles. The bubbles are not visible to the uninitiated at 60 cycles, even though they are there. Since the present invention operates through adjustments of frequency and is not limited to operation at 60 cycles, the present invention is able to eliminate bubbles by the means explained hereinabove.

(f) In a further aspect of the present invention, the section of the ballast circuit which provides a low voltage supply is believed to be unique in the applications disclosed herein. The inventive low voltage supply utilizes, in the preferred embodiment, four diodes and two capacitors which are connected together in a way which saves weight and eliminates the requirement of magnetic components such as those used in the prior art. The inventive low voltage supply circuit uses semiconductors instead of transformers to achieve savings in weight and elimination of magnetic components.

(g) As stated hereinabove, the present invention contemplates structure enabling one to vary the output of the various transformers which are connected in parallel to the power oscillator section of the inventive circuit. In this regard, each transformer is provided with a shunt structure which comprises a pair of parallel shunt devices, one for each side of the transformer which are mounted to move together simultaneously. Such a device may be reciprocated in and out of the transformer structure so as to enable the infinite adjustment of the output of the transformer.

(h) As discussed above in the background of the invention, conventional neon signs are difficult to start and maintain at a bright temperature in cooler weather conditions. The present invention contemplates a solution to this problem which includes attaching of a light sensor directly to the neon tube and interconnecting the sensor to the control chip in a manner such that when the sensor senses that the light output of the sign has reduced and transmits information relating to such sensed condition to the control chip, the control chip is operative to adjust the output frequency of the circuit so as to thereby increase the intensity of the light output of the sign.

(i) In a further aspect, as stated above, prior art neon signs require extremely high voltages in order to operate. The present invention is distinctly superior to prior art neon lighting circuits in that the inventive circuit allows the operation of neon circuits with much lower voltages than are contemplated in the prior art. In the preferred embodiment of the present invention, the output voltage which is generated at the primaries of the output transformers is approximately 162 volts, however, if desired, one could step down the voltage ahead of the primaries of the output transformers to, for example, below 30 volts. As is well known to those skilled in the art, if the transmission lines on a neon sign are carrying less than 30 volts, the electrical codes of most jurisdictions would not require Underwriter's Laboratory approval for the transmission lines. This is a distinct advantage which is provided by the inventive circuit and which would enable an entity to have a sign installed without the intrusion of government regulation.

Accordingly, it is a first object of the present invention to provide an improved line regulated ballast circuit.

It is a further object of the present invention to provide an improved line regulated ballast circuit including a main circuit controlled by a control chip which circuit includes a frequency control regulator as well as a power oscillator sub-circuit.

It is a still further object of the present invention to provide a circuit which may have connected thereto, as desired a function generator enabling one to control output functions in predetermined matters.

It is a still further object of the present invention to provide such a circuit which allows the user thereof to connect a plurality of different output loads thereto in parallel and to drive these output loads simultaneously.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
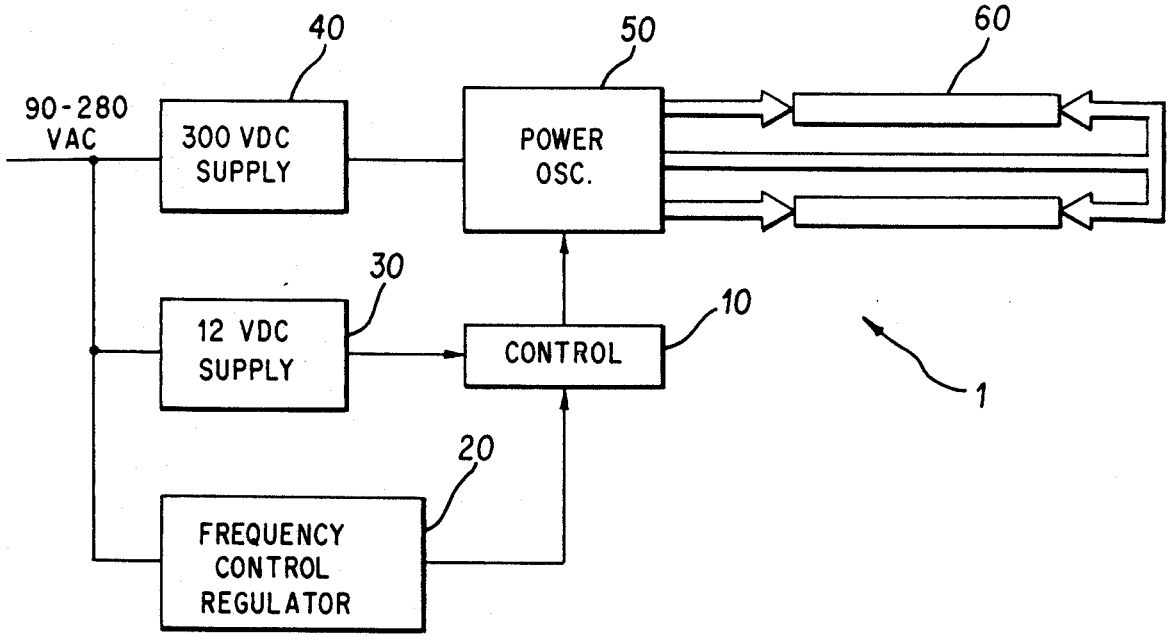
FIG. 1 shows a block diagram of the main portions of the inventive circuit.

Reference is first made to FIG. 1 which shows a block diagram of the inventive line regulated ballast circuit, generally designated by the reference numeral 1. Therein, the control portion of the circuit is designated by the reference numeral 10, the frequency control regulator aspect is designated by the reference numeral 20, the low voltage supply portion is designated by the reference numeral 30 and is illustrated as preferably providing 12 volts DC. Further, the high voltage supply portion is designated by the reference numeral 40 and is designated to provide approximately 300 volts DC. Further, the power oscillator section is designated by the reference numeral 50 and is seen to be connected to a schematically represented load designated by the reference numeral 60. As further shown in FIG. 1, the inventive circuit is preferably connected to a source of alternating current ranging between 90 to 280 volts.

Figure 2:
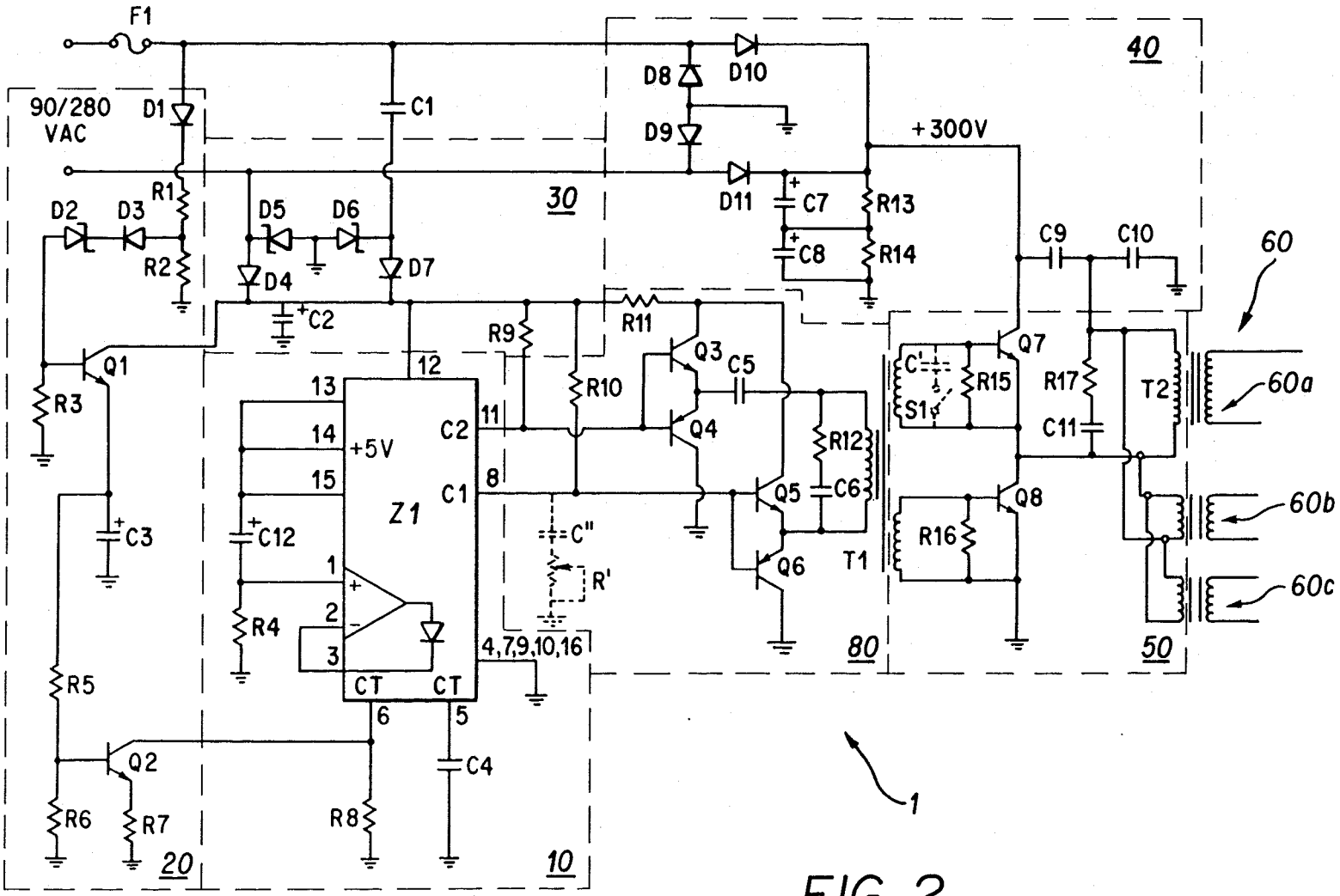
FIG. 2 shows a circuit diagram corresponding to the block diagram of FIG. 1.

With reference to FIG. 2, the portions of the circuit illustrated in FIG. 1 are correspondingly shown in FIG. 2 surrounded by identifying dotted lines. Thus, FIG. 2 clearly shows the sub-circuits 10, 20, 30, 40 and 50 as well as schematic representation of the load 60 as represented by the transformers 60*a*, 60*b*, 60*c* and 60*d*.

Figure 3:
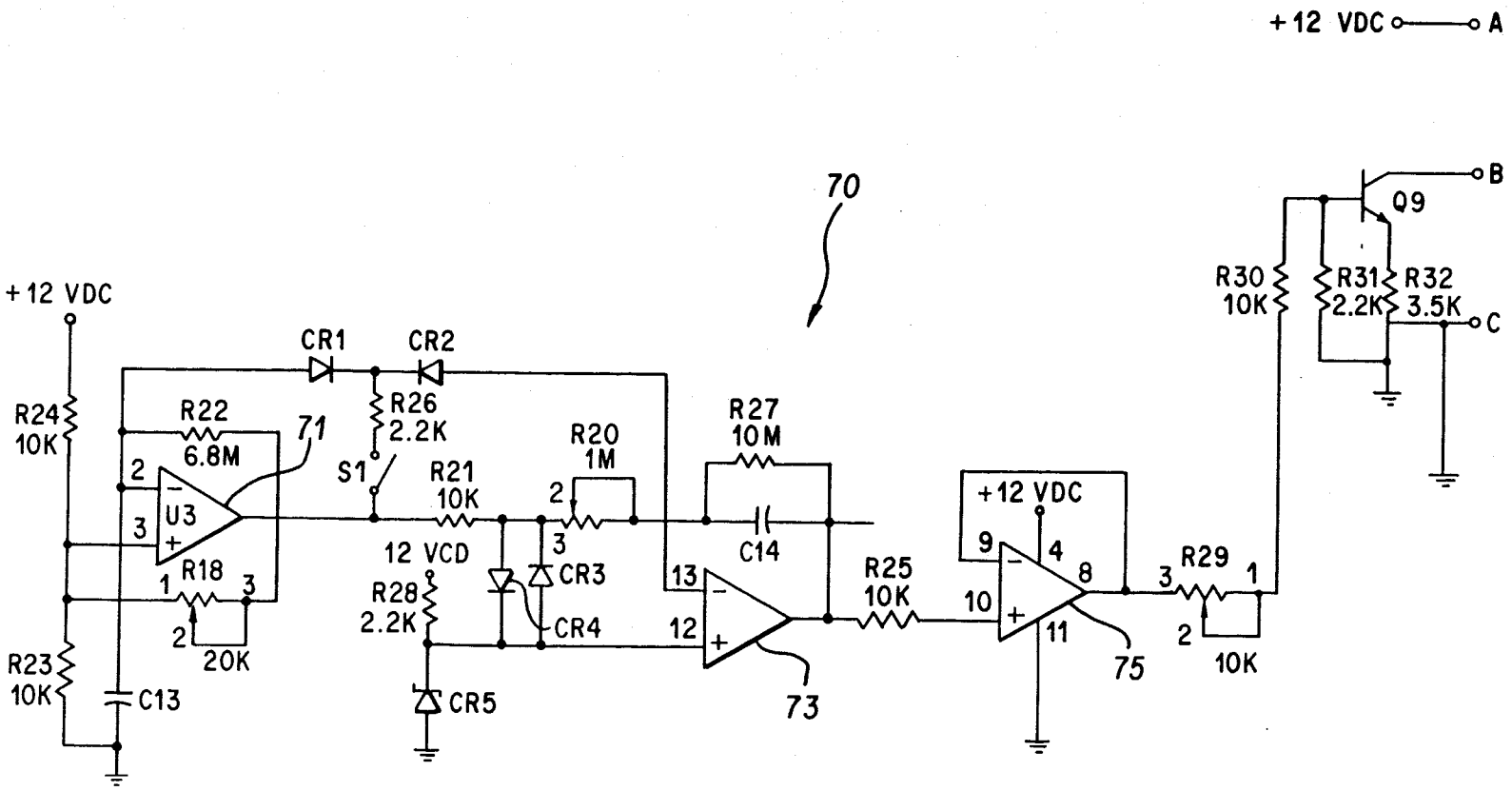
FIG. 3 shows a circuit diagram of the function generator which forms a part of the present invention and is designed to be selectively interconnected with the circuit depicted in FIGS. 1 and 2.

With reference now to FIG. 3, the function generator circuit 70 is shown and includes, among other components, resistors R30, R31, R32 and transistor Q9. With reference to both FIGS. 2 and 3, it should be understood that when the function generator 70 is incorporated into the circuit 1, respective components R5, R6, R7 and Q2 in the circuit 1 are replaced with corresponding respective components R30, R31, R32, Q9. In this manner, the function generator 70 may be incorporated into the circuit 1 for the purposes which will be described in greater detail hereinbelow.

With reference back to FIG. 2, it should be understood that the heart of the circuit 1 which is contained within the control sub-circuit 10 consists of the chip 11 which is a fixed frequency pulse-width-modulation control circuit. In this chip, modulation of output pulses is accomplished by comparison of a sawtooth wave form created by an internal oscillator on the timing capacitor thereof to either of two control signals. The output stage is enabled during that portion of time when the sawtooth voltage is greater than the control signals. As the control signals increase, the period of time the sawtooth input is greater, then decreases. Thus, the output pulse width decreases. The control signals may be derived from several sources such as, for example, the dead-time control and error amplifiers incorporated therein. The dead-time control input is compared directly by the dead-time control comparator. With the control input biased to ground, the output is inhibited during the portion of time the sawtooth wave form is below a predetermined level, such as, for example, 110 mV. This provides pre-set dead time, for example, 3%, with the pulse-width-modulation comparator comparing the control signal created by error amplifiers. A pulse steering flip-flop incorporated therein directs the modulated pulse to each of the two output transistors alternately. In the preferred embodiment of the present invention, the chip which is used in the inventive circuit 1 comprises a Texas Instruments TL494 control circuit chip.

With further reference to FIGS. 1 and 2, the low voltage direct current supply 30 is an off-line non-isolated supply which is formed by the capacitors C1 and C2 and the diodes D4, D5, D6 and D7. In the preferred embodiment, the capacitive resistance of the capacitor C1 is about 1200 ohms so that the current to the low voltage circuit is limited to approximately 100 milliamps. Diodes D4, D5, D6 and D7 form a bridge to rectify the alternating current line voltage with the rectified voltage being filtered by the capacitor C2 to provide 12 volts DC.

The 12 volt output of the supply 30 is properly regulated by making the diodes D5 and D6 of the 12 volt zener type. As should be understood by those skilled in the art, the zener diodes D5 and D6 form a bi-polar clamp which limits the bridge input voltage to 12.6 volts peak to peak. The diodes D4 or D7 present 1 diode drop so that the voltage to the capacitor C2 is limited to 12.6 minus 0.6, or 12 volts.

The high voltage direct current supply 40 operates off-line and is not line isolated. This supply 40 is formed by diodes D8, D9, D10 and D11 as well as by capacitors C7 and C8. The diodes form a bridge which rectifies the alternating current line voltage while the capacitors C7 and C8, as connected in series, filter the rectified alternating current to provide approximately 300 volts DC. The resistors R13 and R14 which are connected across the capacitors C7 and C8 respectively, are bleeder resistors which also provide the function of equalizing voltage across the capacitors C7 and C8.

The portion of the circuit 1 designated by the reference numeral 80 may be termed the output driver sub-circuit. As should be understood by those skilled in the art, the chip 11 provides drive pulses at the pins 8 and 11. The transistors driven by the pins 8 and 11 are open collectors so that pull-up resistors R9 and R10 must be added. The transistors Q3, Q4, Q5 and Q6 form a bridge amplifier to drive the transformer T1. The capacitor C5 blocks DC components which might otherwise saturate the transformer T1. Further, the resistor R12 and the capacitor C6 form a snubbing network which helps reduce parasites in the transformer T1. As should be understood from the above, transformer T1 is the drive transformer for the power oscillator 50.

In a further aspect of the driver section 80, the chip TL494 which is the preferred chip for use in the teachings of the present invention, provides alternate pulse width modulated drive pulses at the pins 8 and 11. The frequency of an internal ramp oscillator contained within the chip TL494 is determined by the values of the resistor R8 and the capacitor C4 which are seen to be connected to the pins 6 and 5 respectively. The operating frequency of the system is $f_0=1/2RC$ which is one-half the ramp oscillator frequency.

One aspect of the operation of the circuit 1 is termed by Applicants "feed forward line regulation". In this regard, normal AC line voltages may be 120, 208 or 240 volts AC. Typical line voltages including line variations may vary ±18% from nominal AC input voltage. Further, lamplight outputs and power inputs may be 40% higher or lower than average, so regulation of the lamp output should be done for the best possible results.

Since power output is a function of frequency, the system operating frequency may be made a function of line voltage as a means of output control. The AC line voltage is scaled, detected and translated to achieve frequency modulation of the ramp oscillator in the control chip 11. The diode D1 which is in the frequency control regulator subcircuit 20 rectifies line voltage to reduce dissipation in the resistor R1. The resistors R1 and R2 scale the line voltage and may be selected for the purpose of adjusting output regulation. The diode D3 prevents exceeding the reach through voltage of the transistor Q1. The zener diode D2 as should be understood, develops a threshhold voltage for frequency control while the resistor R3 provides the required emitter-base DC return for stability of the transistor Q1 with temperature changes.

The transistor Q1 is a current buffer which is provided for changing the filter capacitor C3. The operating voltage of the capacitor C3 is made high enough to reduce tolerance implications of the zener diode D2 so that the resistors R5 and R6 are necessary in order to enable the circuit to scale the detected voltage. The total resistance of the resistors R5 and R6 sets the "ripple voltage" of the capacitor C3. As should be understood, resistance or capacitance selection should be made to match the percent ripple of the capacitor C3 to approximate the percent ripple of the high voltage supply 40.

With regard to the "feed forward line regulation", with further reference to the frequency control regulator subcircuit 20, a sample of the AC line voltage is taken and rectified through the recitifier D1 and the resistors R1 and R2. The output regulation range is determined by the set point of the resistors R1 and R2. The zener diode D2 sets the reference voltage for the transistor Q1. When there is a change in the AC voltage, it is detected through these components at the base of the transistor Q1. The transistor Q1 controls the charge on the filter capacitor C3 and the change of the charge of the capacitor C3 is scaled through the resistors R5 and R6. This, in turn, adjusts the amount of current flow to the transistor Q2. The collector of the transistor Q1 is connected to the pin 6 of the chip 11 (Z1). This gives a parallel current path to the resistor R7 to the timing resistor R8 in order to enable the setting of the frequency of the chip 11.

With reference now to FIG. 3, the details of the function generator 70 will now be discussed. With reference to FIG. 3, it is seen that the function generator circuit 70 includes three operation amplifiers respectively designated by the reference numerals 71, 73 and 75. In the preferred embodiment of the present invention, these operation amplifiers may be like that which is manufactured by RCA under the model designation LM324. As should be well known to those skilled in the art, an LM324 operational amplifier has four operational amplifiers included therewith and in the inventive function generator 70, three of these amplifiers are in fact used in each operational amplifier 71, 73 and 75. With reference to the right hand portion of FIG. 3 and the left hand portion of FIG. 2, it should be understood that when the function generator 70 is connected into the circuit 1, the components R5, R6, R7 and Q2 in the circuit 1 are respectively replaced with the components R30, R31, R32 and Q9 of the function generator circuit 70.

As should be understood, the function generator operates on the pin 6 of the chip 11 in a manner so as to control the frequency output of the chip 11 through the back portion of the circuit via the resistors R30, R31 and R32 and the transistor Q9 via the pin 6. As should be understood, connection of the function generator into the circuit creates a parallel current path to control the frequency of the chip 11.

As shown in FIG. 3, the resistors R18, R20 and R29 are adjustable as to their respective resistance values. As will be described in greater detail hereinbelow, the function generator 70 is interconnected into the line regulated ballast circuit 1 when it is desired to cause a neon tube, for example, to "write". As explained hereinabove, by "write", Applicants mean that the neon tube will light in a manner such that sequentially from one end to the other, the tube is gradually energized in a controlled fashion. The function generator functions of ramp up and ramp down described hereinabove, are utilized to control this writing technique and the function generator 70 is designed to enable the writing technique to be used in a manner wherein the neon tube is written from one end to the other, then deactivated, and then after a predetermined period of time, is written again.

With regard to these functions which are controlled by the function generator 70, adjustments in the resistance of the resistor R18 control the rate at which the writing sequence is recycled. In particular, adjustment of the resistor R18 controls the time at which the neon tube, having been written, is blanked out and then rewritten.

Adjustments in the resistance level of the resistor R20 result in changes in the speed at which the neon tube is actually written from one end to the other. Furthermore, adjustments in the resistance level of the resistor R29 are operative to set the "off point" of the sign which means that point in time when the sign is completely deactivated. Through adjustments of the value of the resistor R29, predetermined lengths of the sign may be blanked while leaving other portions residually lit, however, in most cases, adjustments are made to the resistance value of the resistor R20 merely to ensure that the entire sign is blank in a controllable fashion.

Further, it is noted that as the resistance level of the resistor R18 is increased, the rate of recycling of the writing sequence of the sign is slowed and, conversely, as the resistance is lowered, the rate of recycling is speeded up. Further, increasing the resistance of the resistor R20 will result in a slowing of the speed of writing the neon tube. Conversely, lowering the resistance of the resistor R20 will increase the speed of such writing. Finally, raising the resistance of the resistor R29 will result in blanking out higher percentages of the neon tube during blanking. Conversely, lowering the resistance of the resistor R29 will result in blanking out a lesser percentage of the neon tube. It should be understood that adjustments to the resistor R18 affect the operational amplifier 71, adjustments to the resistor R21 affect the operational amplifier 73 and adjustments to the resistor R29 affect the base voltage of the transistor Q9.

Figure 4:
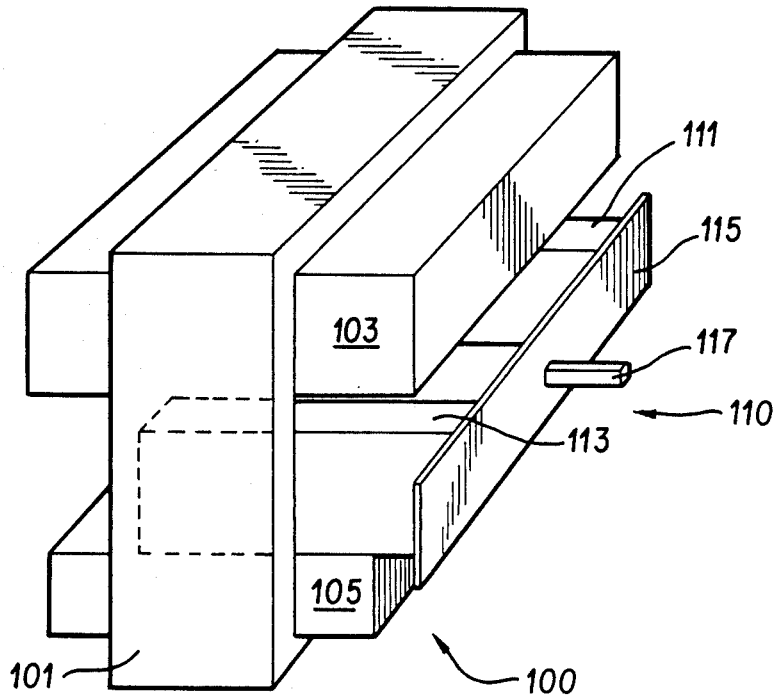
FIG. 4 is a perspective view of a transformer including shunt means in accordance with the teachings of the present invention.

With reference now to FIG. 4, a transformer 100 is shown which has been adapted for use in conjunction with the present invention. As seen in FIG. 4, the transformer includes a ferrite coil 101, windings 103, 105 and a shunt 110 consisting of a first shunt member 111, a second shunt member 113, a plate 115 interconnecting the shunt members 111 and 113 and a handle 117. As should be understood by those skilled in the art, the shunts 111 and 113 are operative to control communication between the windings 103 and 105. The shunt members 111, 113 are designed to completely fill the gap between the windings 103 and 105 so that reciprocation of the shunt 110 by moving the handle 117 will result in predictable variations in the output of the transformer 100. In this regard, as the shunt 110 is pulled out away from the windings 103, 105, the output of the transformer 100 will be increased. Conversely, as the shunt 110 is moved into the transformer 100 between the windings 103, 105, the output of the transformer will be correspondingly reduced.

Now, with disclosure of the invention having been made, in great detail hereinabove, the operation of the various aspects thereof will not be described.

In a first aspect, the circuit 1 is specifically designed to enable the user thereof to control the presence or absence of discontinuous areas in clear luminous tubes, which areas are commonly known as "jelly beans" or "bubbles". One method of eliminating bubbles when using a high frequency transformer at a frequency of on the order of 30KHz is to sample the signal at one side of the switching circuit and to feed the signal back into the timing segment of the control chip 11 which is an integral part of the central circuit 10. This will result in one output of the control chip 11 remaining positive for an extended period of time as compared to the other output. This in turn results in an offset in the output of the switching devices found in the power oscillator 50 and designated by the identifying indicia Q7 and Q8. This offset will eliminate the discontinuities in the gas.

As seen in FIG. 2, the switching devices (transistors) Q7 and Q8 are connected through the transformer T1 to the driver subcircuit 80. As the circuit is constituted, an "antenna effect" exists from the pin 6 of the chip 11 to the transistor Q7. This antenna effect creates an offset which causes the transistor Q7 to stay on longer than the transistor Q8. Thus, the transistors Q7 and Q8 have inbalanced on times in relation one to the other resulting in a breaking up of the harmonics in the tube which would cause the bubbles. If bubbles are desired, the frequency is modulated off the function generator so that the transistors Q7 and Q8 with balanced on time one to another so that the harmonics created in the tube are not inhibited, thus allowing the bubbles to be created.

An alternative structure may be employed to controllably place the transistors Q7 and Q8 out of balance. In this regard, reference is made to FIG. 2 wherein a capacitor C′ is shown in phantom connected in parallel across the resistor R15 and controllably insertable into the circuit through the use of a switch S1. As should be understood, the combination of the resistor R15 and the capacitor C′ comprises an RC circuit which delays the turning off of the transistor Q7. In conjunction with the capacitor C′, in this mode of operation, an additional circuit would be provided as also shown in phantom in FIG. 2, including a capacitor C″ and a resistor R′. This circuit in conjunction with the capacitor C′ is an alternative to the antenna effect described hereinabove and these circuit elements when combined together would cause a delay in the turning off of a transistor Q7 during each cycle thereof.

As explained hereinabove, through the use of the function generator, specifically depicted in FIG. 3, a "writing" phenomenon may be accomplished with a neon tube using alternating current. As explained hereinabove, before the advent of the present invention, the only known circuits which would accomplish "writing" utilized direct current. Such circuits have many drawbacks, including (1) the migration of impurities in the tube which move to one end or the other to create "Farraday's dark spots"; (2) DC based circuits have insufficient power to be effectively used with long tubes and with tubes of large diameter; and (3) direct current circuits light the tube non-uniformly throughout its length with the begining of the tube usually lighting with greater intensity than the end thereof until maximum current is obtained.

When it is desired to "write" with a neon tube, the function generator 70 is interconnected into the circuit 1 in the manner described hereinabove. In order to utilize the function generator 7 to enable the neon tube to "write", the ramp up and ramp down functions of the function generator 70 are employed. First, the ramp up function is employed to raise the frequency of the current going through the tube above the frequency which would cause the tube to light. Thereafter, the ramp down function is employed to gradually reduce the frequency of the output current until the frequency drops below a predetermined threshhold, whereupon the neon tube will begin to light at its beginning and the lit area will gradually increase in length in proportion to the speed of frequency reduction until the entire tube is lit. Thereafter, further reductions of the frequency in the ramp down mode of the function generator 70 will result in increases in the intensity of light emanating from the entirety of the tube. As explained hereinabove, the speed of writing is controlled by the value of the resistor R20 and the rate in which a sequence of writing, erasing and re-writing is controlled by the value of the resistor R18.

Two techniques are employed to ensure that writing may be accomplished in a controlled manner. Firstly, one end of the output transformer T2, for example, is grounded to the ballast circuit 1. Furthermore, in applications where the neon sign includes a lot of overlaps and undulations, an elongated insulated conductor is attached to the entirety of the tube, including all bends and undulations and the end of the conductor at the end of the sign is grounded with the other end being left unconnected. Thus, free flow of current caused by a capacitance phenomenon through the tube walls will occur through the attached conductor to the ground. Again, both of these techniques are employed in situations where the tube has a lot of bends and undulations, but in situations where the tube does not have such overlaps, the writing phenomenon may be properly controlled so long as the output transformer is grounded to the ballast circuit.

It is important to note, with reference to FIG. 1, that when the function generator 70 is connected into the circuit 1 for writing purposes, the components Q1, R3, R2, D2, D3, R1, D1, Q2, R6, R7 and C3 are all eliminated from the circuit since their inclusion into the circuit in conjunction with the function generator would conflict with one another.

Concerning the operation of the function generator 70 in the flash mode, when the function generator is operated so as to enable the tube to flash, this is done by performing the ramp up and ramp down functions rapidly ramping up and ramping down so that the tube writes so fast that the sequential nature of writing is not visible to the human eye.

In the operation of the function generator, the transistor Q9 forms a voltage controlled programmable current source with the collector current of the transistor Q9 being a function of the base voltage and the resistance value of the resistor R32. The resistors R30 and R31 are selected to set the threshhold of the frequency control and the resistor R32 is selected in adjusting output power.

As should be understood in light of the above explanations, when the voltage which comes back to the pin 6 of the chip 11 is ramped up, the frequency of the chip 11 is changed and as this frequency lowers, the output to the neon tube is increased to thereby cause the neon tube to write.

The operation of the transformer 100 with incorporated shunt 110 has been described hereinabove in conjunction with FIG. 4. As has been explained above, a plurality of transformers may be connected into the circuit 1 in parallel with one another as represented by the reference numeral 60*a*, 60*b*, 60*c* and 60*d* in FIG. 2. Each individual transformer may be provided with a shunt like the shunt 110 shown in FIG. 4. In this way with a constant output being provided to the primary of the transformer T2, each individual transformer 60 connected thereacross in parallel may have its output individually controlled through movements of a shunt like the shunt 110. Thus, the circuit 1 may be used to control a plurality of diverse output loads such as neon tubes, fluorescent fixtures and the like simultaneously with each such application being provided with its own transformer 100 with incorporated shunt 110 so that the output of each individual transformer 100 may be individually controlled.

As mentioned hereinabove, the present invention includes provision for compensating for changes in lighting intensity in a neon tube which naturally occur in varying weather conditions. In this regard, it is known that as the ambient temperature gets cooler, it becomes more and more difficult to initially light a neon sign and if the neon sign is lit, the intensity of the light in cooler ambient conditions diminishes. Thus, as stated hereinabove, a need has developed for a system which will compensate for changes in ambiant temperatures.

The present invention contemplates a solution to this problem which includes attaching a photosensor directly to the neon tube so that the sensor will sense light emanating therefrom. The sensor outputs a current proportional to the light intensity sensed thereby. An electrical conductor is provided which electrically connects the sensor to the pin 6 on the chip 11. In this way, the chip 11 will control the intensity of the neon tube by sensing reductions in the current output of the photosensor indicative of reductions in light intensity of the neon tube and responsive thereto, the chip 11 will reduce the output frequency of the circuit 1 thereby increasing the power outputted to the neon tube to thereby increase the intensity until such time as the current level in the electrical conductor attached to the photosensor rises to the level indicative of the required intensity level of the neon tube.

It is noted that this structure for compensating for differing ambient temperature conditions is not usable in accordance with the present invention in conjunction with the function generator 70 or the feed forward circuit. This is because both systems utilize frequency control and if connected simultaneously into the circuit would work at cross-purposes with respect to one another and would thus both become ineffective.

Applicants have found that the circuit 1, when operated with the input of 208 to 240 volts AC provides an output voltage at the primaries of the transformer T2 of 162 volts. If desired, however, a transformer or other stepdown device, could be interposed ahead of the transformer T2 to step down the voltage to a lower figure. Since prior art ballast circuits for use in neon applications in particular require high voltages of on the order of up to 15,000 volts, even a level of 162 volts is a distinct advance thereover. Applicant has found that the voltage ahead of the transformer T2 may be stepped down to below 30 volts and the circuit will still effectively drive neon signs and fluorescent fixtures to the point of the modular step-up transformer. This is quite significant because most states have electrical codes requiring Underwriter's Laboratory approval for a transmission line wherein the output voltage is more than 30 volts. Thus, if the output voltage of the circuit 1 were stepped down from 162 volts to, for example, 24 volts, Underwriter's Laboratory approval would not be necessary for a neon sign employing such circuit. Of course, as explained hereinabove, the transformer T2 may have connected thereto a plurality of transformers in parallel, each of which may include a shunt such as the shunt 110 shown in FIG. 4. These shunts would provide an additional output control for each individual application.

Further, the inventive circuit 1 includes provision for "soft start" which controls the output power to the load at turn-on. At turn-on, the duty cycle of the drive pulses are reduced to zero and allowed to increase gradually to about 95% duty cycle for full power output. The soft start period during which this occurs is determined by the time constant of the capacitor C12 and the resistor R4. At turn-on, the reference voltage rises from 0 to +5 volts so that the charging of the capacitor C12 pulls the pin 1 of the chip 11 high. The pin 1 controls the duty cycle of the drive pulses, so as the capacitor C1 charges, the voltage on the pin 1 of the chip 11 falls, thereby increasing the duty cycle of the drive pulses. If desired, the soft start option may be inhibited by deleting the capacitor C2.

Accordingly, an invention has been disclosed in terms of its various aspects, features and functions which fulfills each and every one of the objects as set forth hereinabove and which overcomes all the deficiencies in the prior art discussed hereinabove. Of course, many variations, changes and alterations in the teachings of the present invention may be contemplated by those skilled in the art without departing from the intended spirit and scope of the present invention. Accordingly, it is stressed that it is intended that the present invention only be limited by the terms of the appended claims.

We claim:

1. A ballast circuit for controlling illumination device means comprising:

(a) a control chip;

(b) driver sub-circuit means connected to said control chip for receiving drive pulses from predetermined pins of said chip said driver subcircuit means further including a bridge amplifier driving first transformer means;

(c) power oscillator sub-circuit means connected to said first transformer means and having two transistors connected in parallel across said first transformer means and including a second transformer means;

(d) power supply means for providing direct current power to said circuit; and (e) said illumination device means being connected to said second transformer means.

2. The invention of claim 1, wherein said illumination device means comprises a plurality of separate illumination devices.

3. The invention of claim 2, wherein said second transformer means comprises a plurality of transformers connected into said power oscillator sub-circuit means in parallel with a separate illumination device being connected to each said transformer.

4. The invention of claim 1, wherein said power supply means comprises a low voltage power supply and a high voltage power supply.

5. The invention of claim 1, further including a frequency control regulator connected to said control chip and said power supply means.

6. The invention of claim 1, further including function generator means connected to said circuit for controlling said chip and illumination device means.

7. The invention of claim 6, wherein said illumination device means comprises a neon tube, said function generator means being operative to control said neon tube to slowly light sequentially from one end to another end thereof.

8. The invention of claim 6 wherein said function generator means includes function means for controlling said chip wherein said illumination device means may be flashed or modulated.

9. The invention of claim 1, wherein said second transformer means includes shunt means for adjusting the output thereof.

10. The invention of claim 3, wherein each said transformer includes a shunt device which may be adjusted to control the output thereof.

* * * * *